US010731106B2

(12) United States Patent
Scialla et al.

(10) Patent No.: US 10,731,106 B2
(45) **Date of Patent: *Aug. 4, 2020**

(54) DISHWASHING CLEANING COMPOSITION

(71) Applicant: The Procter & Gamble Company, Cincinnati, OH (US)

(72) Inventors: Stefano Scialla, Strombeek Bever (BE); Rachel Elizabeth Martin, Newcastle upon Tyne (GB); Karen Margaret Preston, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/149,222

(22) Filed: Oct. 2, 2018

(65) Prior Publication Data

US 2019/0106655 A1 Apr. 11, 2019

(30) Foreign Application Priority Data

Oct. 5, 2017 (EP) ..... 17195051

(51) Int. Cl.

| | |
|---|---|
| ***C11D 3/33*** | (2006.01) |
| ***C11D 3/37*** | (2006.01) |
| ***B08B 3/04*** | (2006.01) |
| ***C11D 1/62*** | (2006.01) |
| ***C11D 11/00*** | (2006.01) |
| ***C11D 17/04*** | (2006.01) |
| ***C11D 7/32*** | (2006.01) |
| ***C11D 3/22*** | (2006.01) |
| ***C11D 3/36*** | (2006.01) |
| ***C11D 3/39*** | (2006.01) |

(52) U.S. Cl.

CPC ..... *C11D 1/62* (2013.01); *C11D 3/225* (2013.01); *C11D 3/33* (2013.01); *C11D 3/361* (2013.01); *C11D 3/37* (2013.01); *C11D 3/3769* (2013.01); *C11D 3/3776* (2013.01); *C11D 3/392* (2013.01); *C11D 7/3245* (2013.01); *C11D 11/0023* (2013.01); *C11D 17/042* (2013.01); *C11D 17/043* (2013.01); *C11D 17/044* (2013.01); *C11D 17/045* (2013.01)

(58) Field of Classification Search

CPC ..... C11D 3/33; C11D 3/3769; C11D 3/3776; C11D 17/042; B08B 3/04

See application file for complete search history.

(56) References Cited

U.S. PATENT DOCUMENTS

| | | | | |
|---|---|---|---|---|
| 5,856,164 | A | 1/1999 | Outtrup et al. | |
| 6,093,562 | A | 7/2000 | Bisgard et al. | |
| 6,403,355 | B1 | 6/2002 | Hagihara et al. | |
| 7,153,818 | B2 | 12/2006 | Breves et al. | |
| 10,227,553 | B2 * | 3/2019 | Ward | A47L 15/0007 |
| 10,287,533 | B2 * | 5/2019 | Letzelter | C11D 3/3707 |
| 2005/0113280 | A1 | 5/2005 | Reddy et al. | |
| 2007/0129516 | A1 | 6/2007 | Detering et al. | |
| 2008/0193999 | A1 | 8/2008 | Andersen et al. | |
| 2016/0222325 | A1 | 8/2016 | Letzelter et al. | |
| 2017/0096626 | A1 | 4/2017 | Tollens et al. | |
| 2017/0355929 | A1 | 12/2017 | Letzelter et al. | |

FOREIGN PATENT DOCUMENTS

| | | | |
|---|---|---|---|
| WO | WO9623873 | A1 | 8/1996 |
| WO | WO9700324 | A1 | 1/1997 |
| WO | WO9923211 | A1 | 5/1999 |
| WO | WO0037627 | A1 | 6/2000 |
| WO | WO0060060 | A2 | 10/2000 |

OTHER PUBLICATIONS

Extended European Search Report; Application No. 17195051.2-1358; dated Nov. 12, 2017; 8 pages.

* cited by examiner

*Primary Examiner* — Brian P Mruk

(74) *Attorney, Agent, or Firm* — John T. Dipre

(57) ABSTRACT

A dishwashing composition including a copolymer including polyalkylene oxide groups and quaternary nitrogen atoms and more than 30% by weight of the composition of a complexing agent.

19 Claims, No Drawings

DISHWASHING CLEANING COMPOSITION

FIELD OF INVENTION

The present invention relates to a cleaning composition, in particular, a dishwashing composition comprising a copolymer comprising polyalkylene oxide groups and quaternary nitrogen atoms and a complexing agent. The composition provides cleaning that can be seen and felt. It is good for prevention of spotting and to improve shine in dishwashing, in particular in automatic dishwashing.

BACKGROUND OF THE INVENTION

The role of a dishwashing composition is twofold: to clean soiled dishware and to leave it shiny. Typically, when water dries from surfaces water-marks, smears and/or spots are left behind. These water-marks may be due to the evaporation of water from the surface leaving behind deposits of minerals which were present as dissolved solids in the water, for example calcium, magnesium and sodium ions and salts thereof or may be deposits of water-carried soils, or even remnants from the cleaning product, for example soap scum. During the course of this work, it has been observed that this problem can be often exacerbated by some cleaning compositions which modify the surface of the dishware during the automatic dishwashing process in such a way that after rinsing, water forms discrete droplets or beads of water remain on the surface instead of draining off. These droplets or beads dry to leave noticeable spots or marks known as water-marks. This problem is particularly apparent on ceramic, stainless steel, plastic, glass and painted surfaces.

When items are washed in an automatic dishwasher it is important to the consumer that those items come out at the end of the cycle as clean as possible. An item is clean to the consumer if there are no visible pieces of soil or hard water deposits. This means no films, spots, grit or residues of anything. It is also as important that when the consumer touches the items they do not feel anything other than the clean surface of item. When an item is not clean, a consumer may feel either a rough and gritty surface or they may feel a greasy surface.

A rough and gritty surface can be produced when hard water deposits, i.e. calcium carbonate and other salts deposit on the item. This can be accentuated if there are food soils mixed in with the deposits. A greasy surface can be produced if excess greases and fat soils from the wash liquor of the dishwashing process have been deposited onto the item. Whether rough and gritty or greasy, these feelings are unpleasant for the consumer and indicate that the items which they have washed are not clean.

The object of the present invention is to provide a dishwashing composition that leaves the washed dishware clean with reduced incidence or spots.

SUMMARY OF THE INVENTION

According to the first aspect of the invention, there is provided a dishwashing cleaning composition. The composition comprises a cationic copolymer. The "cationic copolymer" is sometimes herein referred to as the copolymer of the invention.

For the purpose of this invention "dishwashing" encompasses both manual dishwashing and automatic dishwashing.

For the purpose of this invention "dishware" encompasses tableware, cookware and any food-holding/handling items used for cooking and/or eating.

By "cationic" copolymer is herein meant a copolymer having a net positive charge under the conditions of use. The polymer can have anionic monomers but the net charge when the polymer is used in the composition of the invention in a dishwashing operation is cationic. The cationic nature of the co-polymer contributes to its affinity for negatively charged surfaces such as glass, ceramic and stainless steel.

Without wishing to be bound by theory, it is believed that the copolymer works by facilitating efficient drainage of the wash liquor and/or rinsing water by forming rivulets. This helps prevent the generation of aqueous droplets which, upon drying, can result in deposition of residues on the dishware surface and consequent formation of visible spots or streaks. The copolymer helps to prevent the re-deposition of soils on the washed surfaces. The increase in rivulet formation can prevent the deposition of hard water salts, food soils and grease. This results in overall cleaner feeling surfaces.

One method of measuring the clean feeling provided by a composition is by using texture analysis. This measures the friction coefficient as a metal sled is dragged along the surface of an item. A greasy surface will give a low friction coefficient as the sled slides along easily. A rough and gritty surface gives a high friction coefficient as more force is required to move the sled. The composition of the invention produces a friction coefficient which is between the two ends of the spectrum and represents a feel that is highly desirable to the consumer.

The copolymer has sufficient surface substantivity to remain on the surface of the dishware during the rinse cycles, thus providing the drainage action in the rinse phase even if the co-polymer has been delivered into the main wash solution, together with the rest of the cleaning composition. This reduces or eliminates the need for a separate rinse aid product. The composition of the invention provides benefits on glass, ceramics, plastics and stainless steel dishware.

The copolymer provides a moderate hydrophilic modification. It improves both spotting and filming. The cationic nature of the copolymer contributes to its affinity for the negatively charged surfaces such as glass.

The copolymer of the invention is the result of the copolymerization of: monomer (A): a monoethylenically unsaturated polyalkylene oxide monomer and monomer (B): a quaternized nitrogen-containing monomer and optionally monomer (C): an anionic monoethylenically unsaturated monomer and monomer (D): a nonionic monoethylenically unsaturated monomer. Preferably, the copolymer has a weight average molecular weight (Mw) from 20,000 g/mol to 200,000 g/mol, preferably from 30,000 g/mol to 200,000 g/mol, more preferably from 35,000 g/mol to 100,000 g/mol.

Preferably the weight ratio of monomer (A) to monomer (B) is greater than 2:1, more preferably greater than 3:1 and preferably less than 5:1 and for the case where the copolymer comprises a monomer (C), the weight ratio of monomer (B) to monomer (C) is also greater than 2:1 and more preferably greater than 2.5:1 and preferably less than 20:1. Copolymers having these ratios seem to impart the surfaces washed the right surface modification to decrease the number of spots and filming and provide shiny surfaces.

Preferred copolymers for use herein are those comprising methylpolyethylene glycol (meth)acrylate as monomer (A). Also preferred copolymers for use herein are those comprising a salt of 3-methyl-1-vinylimidazolium as monomer (B). Especially preferred copolymers for use herein comprises methylpolyethylene glycol (meth)acrylate as monomer (A) and a salt of 3-methyl-1-vinylimidazolium as monomer (B). More preferably the copolymer comprises from 70 to 80% by weight of the copolymer of methylpolyethylene glycol (meth)acrylate and from 10 to 30% by weight of the copolymer of a salt of 3-methyl-1-vinylimidazolium. These copolymers have been found to reduce the number of spots and filming on washed surfaces leaving the surfaces shiny.

There are also preferred copolymers comprising methylpolyethylene glycol (meth)acrylate as monomer (A) and a salt of 3-methyl-1-vinylimidazolium as monomer (B) and the weight ratios indicated herein before.

Preferred copolymers are those in which R2 of formula I is ethylene and n is from 20 to 100, more preferably from 15 to 90 and especially from 20 to 60.

The composition of the invention is suitable for hand dishwashing and automatic dishwashing. When the composition is an automatic dishwashing composition the composition is preferably phosphate free. By "phosphate-free" is herein understood that the composition comprises less than 1%, preferably less than 0.1% by weight of the composition of phosphate.

The automatic dishwashing composition comprises more than 30%, more preferably from 35 to 55% by weight of the composition of a complexing agent, more preferably from 35 to 50% by weight of the composition of a salt of methyl glycine diacetic acid, preferably the trisodium salt. The combination of the copolymer with the high level of the complexing agent contributes to excellent cleaning and finishing.

Preferably the automatic dishwashing cleaning composition is in unit-dose form, more preferably in the form of a water-soluble pouch. By "unit-dose form" is herein meant that the composition is provided in a form sufficient to provide enough detergent for one wash. Suitable unit dose forms include tablets, sachets, capsules, pouches, etc. Preferred for use herein are compositions in unit-dose form wrapped in water-soluble material, for example polyvinyl alcohol. Especially preferred are compositions in unit dose form wrapped in a polyvinyl alcohol film having a thickness of less than 100 μm. The detergent composition of the invention weighs from about 8 to about 25 grams, preferably from about 10 to about 20 grams. This weight range fits comfortably in a dishwasher dispenser. Even though this range amounts to a low amount of detergent, the detergent has been formulated in a way that provides all the benefits mentioned herein above.

According to the second and the third aspects of the invention, there are provided a method of automatic and a method of manual dishwashing, using the composition of the invention. Dishware cleaned according to the methods of the invention is left with a reduced number of spots and filming and very shiny. The dishware not only looks but also feels clean.

According to the last aspect of the invention, there is provided the use of the copolymer of the composition of the invention in a dishwashing cleaning composition, preferably an automatic dishwashing composition, to reduce spots formation during dishwashing and to provide visual and tactile cleanness.

The elements of the composition of the invention described in connection with the first aspect of the invention apply mutatis mutandis to the other aspects of the invention.

DETAILED DESCRIPTION OF THE INVENTION

The present invention encompasses a dishwashing cleaning composition, preferably an automatic dishwashing cleaning composition, comprising a cationic copolymer and a high level of a complexing agent, preferably a salt of methyl glycine diacetic acid. The composition provides excellent cleaning and shine. The invention also encompasses methods of dishwashing, preferably a method of automatic dishwashing, using the composition. The invention also encompasses the use of the copolymer in a dishwashing cleaning composition, preferably an automatic dishwashing cleaning composition, to reduce spotting on the washed items and to provide cleanness that can be seen and felt.

Cationic Copolymer

The cleaning composition of the invention preferably comprises from about 0.01% to about 10%, more preferably from about 0.05% to about 8%, especially from about 0.1% to about 7%, by weight of the cleaning composition, of the copolymer. The copolymer comprises monomers selected from the group comprising monomers of formula (I) (Monomer (A)) and monomers of formula (IIa-IId) (Monomer (B)). Monomer (A) comprises from about 60 to about 99%, preferably from about 70 to about 95% and especially from about 75 to about 85% by weight of the copolymer of at least one monoethylenically unsaturated polyalkylene oxide monomer of the formula (I)

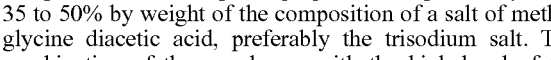

$$H_2C{=}CR^1{-}X{-}Y{-}({-}R^2{-}O{-})_n{-}R^3$$

wherein Y of formula (I) is selected from —O— and —NH—; if Y of formula (I) is —O—, X of formula (I) is selected from $—CH_2—$ or —CO—, if Y of formula (I) is —NH—, X of formula (I) is —CO—; $R^1$ of formula (I) is selected from hydrogen, methyl, and mixtures thereof; $R^2$ of formula (I) is independently selected from linear or branched $C_2$-$C_6$-alkylene radicals, which may be arranged blockwise or randomly; $R^3$ of formula (I) is selected from hydrogen, $C_1$-$C_4$-alkyl, and mixtures thereof; n of formula (I) is an integer from 20 to 100, preferably from 20 to 80 and more preferably from 30 to 60.

Monomer (B) comprises from about 1 to about 40%, preferably from about 5 to 35% and especially from about 10 to about 30% by weight of the copolymer of at least one quaternized nitrogen-containing monoethylenically unsaturated monomer of formula (IIa-IId).

The monomers are selected such that the copolymer has a weight average molecular weight ($M_w$) of from 50,000 to 500,000 g/mol, preferably from greater than 60,000 to 400,000 g/mol and especially from 70,000 to 200,000 g/mol.

The copolymer for use in the present invention may further comprise monomers (C) and/or (D). Monomer (C) may comprise from 0% to about 15%, preferably from 0 to about 10% and especially from 1 to about 7% by weight of the copolymer of an anionic monoethylenically unsaturated monomer.

Monomer (D) may comprise from 0% to about 30%, preferably from 0 to about 20% and especially from 0 to about 10% by weight of the copolymer of other nonionic monoethylenically unsaturated monomers.

Preferred copolymers according to the invention comprise, as copolymerized Monomer (A), monoethylenically unsaturated polyalkylene oxide monomers of formula (I) in which Y of formula (I) is —O—; X of formula (I) is —CO—; $R^1$ of formula (I) is hydrogen or methyl; $R^2$ of formula (I) is independently selected from linear or branched $C_2$-$C_4$-alkylene radicals arranged blockwise or randomly, preferably ethylene, 1,2- or 1,3-propylene or mixtures thereof, particularly preferably ethylene; $R^3$ of formula (I) is methyl; and n is an integer from 30 to 60.

Monomer (A)

A monomer (A) for use in the copolymer of the present invention may be, for example the reaction product of:

(A) (meth)acrylic acid and (meth)acylamide with polyalkylene glycols which are not terminally capped or terminally capped at one end by alkyl radicals; and (B) allyl ethers of polyalkylene glycols which are not terminally capped or terminally capped at one end by alkyl radicals.

Preferred monomer (A) is the (meth)acrylates and the allyl ethers, where the acrylates and primarily the methacrylates are particularly preferred. Particularly suitable examples of the monomer (A) are:

(A) methylpolyethylene glycol (meth)acrylate and (meth) acrylamide, methylpolypropylene glycol (meth)acrylate and (meth)acrylamide, methylpolybutylene glycol (meth)acrylate and (meth)acrylamide, methylpoly(propylene oxide-co-ethylene oxide) (meth)acrylate and (meth)acrylamide, ethylpolyethylene glycol (meth)acrylate and (meth)acrylamide, ethylpolypropylene glycol (meth)acrylate and (meth)acrylamide, ethylpolybutylene glycol (meth)acrylate and (meth) acrylamide and ethylpoly(propylene oxide-co-ethylene oxide) (meth)acrylate and (meth)acrylamide, each with 20 to 100, preferably 30 to 70 and particularly preferably 35 to 60, alkylene oxide units, where methylpolyethylene glycol acrylate is preferred and methylpolyethylene glycol methacrylate is particularly preferred;

(B) ethylene glycol allyl ethers and methylethylene glycol allyl ethers, propylene glycol allyl ethers and methylpropylene glycol allyl ethers each with 20 to 100, preferably 30 to 70 and particularly preferably 35 to 60, alkylene oxide units.

The proportion of Monomer (A) in the copolymer according to the invention is 60% to 99% by weight, preferably 65% to 90% by weight of the copolymer.

Monomer (B)

Suitable monomers have the formula IIa to IId:

IIa

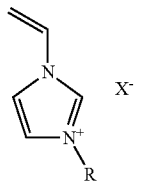

IIb

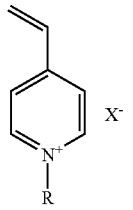

IIc

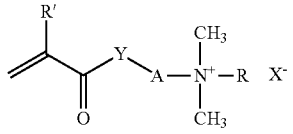

IId

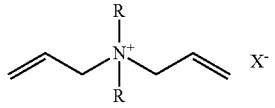

wherein R of formula IIa to IId is selected from $C_1$-$C_4$-alkyl or benzyl, preferably methyl, ethyl or benzyl; R' of formula IIc is selected from hydrogen or methyl; Y of formula IIc is selected from —O— or —NH—; A of formula IIc is selected from $C_1$-$C_6$-alkylene, preferably straight-chain or branched $C_2$-$C_4$-alkylene, in particular 1,2-ethylene, 1,3- and 1,2-propylene or 1,4-butylene; X— of formula IIa to IId is selected from halide, such as iodide and preferably chloride or bromide, $C_1$-$C_4$-alkyl sulfate, preferably methyl sulfate or ethyl sulfate, $C_1$-$C_4$-alkylsulfonate, preferably methylsulfonate or ethylsulfonate, $C_1$-$C_4$-alkyl carbonate; and mixtures thereof.

Specific examples of preferred monomer (B) that may be utilized in the present invention are: (A) 3-methyl-1-vinylimidazolium chloride, 3-methyl-1-vinylimidazolium methyl sulfate, 3-ethyl-1-vinylimidazolium ethyl sulfate, 3-ethyl-1-vinylimidazolium chloride and 3-benzyl-1-vinylimidazolium chloride;

(B) 1-methyl-4-vinylpyridinium chloride, 1-methyl-4-vinylpyridinium methyl sulfate and 1-benzyl-4-vinylpyridinium chloride;

(C) methacrylamidopropyltrimethylammoniu chloride, methacrylamidoethyltrimethylammonium chloride, trimethylammonium ethyl acrylate chloride and methyl sulfate, trimethylammonium ethyl methacrylate chloride and methyl sulfate, dimethylethylammonium ethyl acrylate ethyl sulfate, dimethylethylammonium ethylmethacrylate ethyl sulfate, trimethylammonium propyl acrylate chloride and methyl sulfate and trimethylammonium propyl methacrylate chloride and methyl sulfate; and (D) dimethyldiallylammonium chloride and diethyldiallylammonium chloride.

A preferred monomer (B) is selected from 3-methyl-1-vinylimidazolium chloride, 3-methyl-1-vinylimidazolium methyl sulfate, methacrylamidopropyltrimethylammonium chloride, trimethylammonium ethyl methacrylate chloride, dimethylethylammonium ethylmethacrylate ethyl sulfate and dimethyldiallylammonium chloride.

The copolymer according to the invention comprises 1% to 40% by weight, preferably 3% to 30% by weight of the copolymer, of Monomer (B). The weight ratio of Monomer (A) to Monomer (B) is preferably equal to or greater than 2:1, preferably 3:1 to 5:1.

Monomer (C)

As optional components of the copolymer of the present invention, monomers (C) and (D) may also be utilized. Monomer (C) is selected from anionic monoethylenically unsaturated monomers. Suitable monomer (C) may be selected from:

(A) α,β-unsaturated monocarboxylic acids which preferably have 3 to 6 carbon atoms, such as acrylic acid, methacrylic acid, ethacrylic acid, crotonic acid and vinylacetic acid, preference being given to acrylic acid and methacrylic acid;

(B) unsaturated dicarboxylic acids, which preferably have 4 to 6 carbon atoms, such as itaconic acid and maleic acid, anhydrides thereof, such as maleic anhydride;

(C) ethylenically unsaturated sulfonic acids, such as vinylsulfonic acid, acrylamido-propanesulfonic acid, methallylsulfonic acid, methacrylsulfonic acid, m- and p-styrenesulfonic acid, (meth)acrylamidomethanesulfonic acid, (meth)acrylamidoethanesulfonic acid, (meth)acrylamidopropanesulfonic acid, 2-(meth)acrylamido-2-methylpropanesulfonic acid, 2-acrylamido-2-butanesulfonic acid, 3-methacrylamido-2-hydroxypropanesulfonic acid, methanesulfonic acid acrylate, ethanesulfonic acid acrylate, propanesulfonic acid acrylate, allyloxybenzenesulfonic acid, methallyloxybenzenesulfonic acid and 1-allyloxy-2-hydroxypropanesulfonic acid; and (D) ethylenically unsaturated phosphonic acids, such as vinylphosphonic acid and m- and p-styrenephosphonic acid.

The anionic Monomer (C) can be present in the form of water soluble free acids or in water-soluble salt form, especially in the form of alkali metal and ammonium, in particular alkylammonium, salts, and preferred salts being the sodium salts.

A preferred Monomer (C) may be selected from acrylic acid, methacrylic acid, maleic acid, vinylsulfonic acid, 2-(meth)acrylamido-2-methylpropanesulfonic acid and vinylphosphonic acid, particular preference being given to acrylic acid, methacrylic acid and 2-acrylamido-2-methylpropanesulfonic acid.

The proportion of monomer (C) in the copolymer of the invention can be up to 15% by weight, preferably from 1% to 5% by weight of the copolymer. If Monomer (C) is present in the copolymer of the present invention, then the weight ratio of Monomer (A) to Monomer (C) is preferably equal to or greater than 4:1, more preferably equal to or greater than 5:1.

Monomer (D)

As an optional component of the copolymer of the present invention, monomer (D) may also be utilized. Monomer (D) is selected from nonionic monoethylenically unsaturated monomers selected from:

(A) esters of monoethylenically unsaturated $C_3$-$C_6$-carboxylic acids, especially acrylic acid and methacrylic acid, with monohydric $C_1$-$C_{22}$-alcohols, in particular $C_1$-$C_{16}$-alcohols; and hydroxyalkyl esters of monoethylenically unsaturated $C_3$-$C_6$-carboyxlic acids, especially acrylic acid and methacrylic acid, with divalent $C_2$-$C_4$-alcohols, such as methyl (meth)acrylate, ethyl (meth)acrylate, n-butyl (meth) acrylate, sec-butyl (meth)acrylate, tert-butyl (meth)acrylate, ethylhexyl (meth)acrylate, decyl (meth)acrylate, lauryl (meth)acrylate, isobornyl (meth)acrylate, cetyl (meth)acrylate, palmityl (meth)acrylate and stearyl (meth)acrylate, hydroxyethyl (meth)acrylate, hydroxypropyl (meth)acrylate and hydroxybutyl (meth)acrylate;

(B) amides of monoethylenically unsaturated $C_3$-$C_6$-carboxylic acids, especially acrylic acid and methacrylic acid, with $C_1$-$C_{12}$-alkylamines and di($C_1$-$C_4$-alkyl)amines, such as N-methyl(meth)acrylamide, N,N-dimethyl(meth)acrylamide, N-ethyl(meth)acrylamide, N-propyl(meth)acrylamide, N-tert-butyl(meth)acrylamide, N-tert-octyl(meth)acrylamide and N-undecyl(meth)acrylamide, and (meth) acrylamide;

(C) vinyl esters of saturated $C_2$-$C_{30}$-carboxylic acids, in particular $C_2$-$C_{14}$-carboxylic acids, such as vinyl acetate, vinyl propionate, vinyl butyrate, vinyl 2-ethylhexanoate and vinyl laurate;

(D) vinyl $C_1$-$C_{30}$-alkyl ethers, in particular vinyl $C_1$-$C_{18}$-alkyl ethers, such as vinyl methyl ether, vinyl ethyl ether, vinyl n-propyl ether, vinyl isopropyl ether, vinyl n-butyl ether, vinyl isobutyl ether, vinyl 2-ethylhexyl ether and vinyl octadecyl ether;

(E) N-vinylamides and N-vinyllactams, such as N-vinylformamide, N-vinyl-N-methylformamide, N-vinylacetamide, N-vinyl-N-methylacetamide, N-vinylpyrrolidone, N-vinylpiperidone, N-vinylimidazol, N-vinylpiridine and N-vinylcaprolactam;

(F) aliphatic and aromatic olefins, such as ethylene, propylene, $C_4$-$C_{24}$-α-olefins, in particular $C_4$-$C_{16}$-α-olefins, e.g. butylene, isobutylene, diisobutene, styrene and α-methylstyrene, and also diolefins with an active double bond, e.g. butadiene;

(G) unsaturated nitriles, such as acrylonitrile and methacrylonitrile.

A preferred monomer (D) is selected from methyl (meth) acrylate, ethyl (meth)acrylate, (meth)acrylamide, vinyl acetate, vinyl propionate, vinyl methyl ether, N-vinylformamide, N-vinylpyrrolidone and N-vinylcaprolactam.

If the monomer (D) is present in the copolymer of the present invention, then the proportion of monomer (D) may be up to 30% by weight of the copolymer.

Preferred copolymers of the present invention include

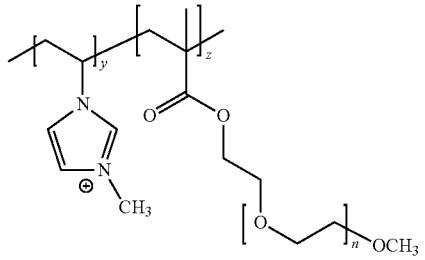

wherein indices y and z are such that the monomer ratio (z:y) is from 3:1 to 5:1 and has a weight average molecular weight between 100,000 and 300,000 g/mol.

The copolymers according to the invention can be prepared by free-radical polymerization of the Monomers (A) and (B) and if desired (C) and/or (D). The free-radical polymerization of the monomers can be carried out in accordance with all known methods, preference being given to the processes of solution polymerization and of emulsion polymerization. Suitable polymerization initiators are compounds which decompose thermally or photochemically (photoinitiators) to form free radicals, such as benzophenone, acetophenone, benzoin ether, benzyl dialkyl ketones and derivatives thereof.

The polymerization initiators are used according to the requirements of the material to be polymerized, usually in amounts of from 0.01% to 15%, preferably 0.5% to 5% by weight based on the monomers to be polymerized, and can be used individually or in combination with one another.

Instead of a quaternized Monomer (B), it is also possible to use the corresponding tertiary amines In this case, the quaternization is carried out after the polymerization by reacting the resulting copolymer with alkylating agents, such as alkyl halides, dialkyl sulfates and dialkyl carbonates, or benzyl halides, such as benzyl chloride. Examples of suitable alkylating agents which may be mentioned are, methyl chloride, bromide and iodide, ethyl chloride and bromide, dimethyl sulfate, diethyl sulfate, dimethyl carbonate and diethyl carbonate.

The anionic monomer (C) can be used in the polymerization either in the form of the free acids or in a form partially or completely neutralized with bases. Specific examples that may be listed are: sodium hydroxide solution, potassium hydroxide solution, sodium carbonate, sodium hydrogen carbonate, ethanolamine, diethanolamine and triethanolamine.

To limit the molar masses of the copolymers according to the invention, customary regulators can be added during the polymerization, e.g. mercapto compounds, such as mercaptoethanol, thioglycolic acid and sodium disulfite. Suitable amounts of regulator are 0.1% to 5% by weight based on the monomers to be polymerized.

Automatic Dishwashing Cleaning Composition

The automatic dishwashing cleaning composition can be in any physical form. It can be a loose powder, a gel or presented in unit dose form. Preferably it is in unit dose form, unit dose forms include pressed tablets and water-soluble packs. The automatic dishwashing cleaning composition of the invention is preferably presented in unit-dose form and it can be in any physical form including solid, liquid and gel form. The composition of the invention is very well suited to be presented in the form of a multi-compartment pack, more in particular a multi-compartment pack comprising compartments with compositions in different physical forms, for example a compartment comprising a composition in solid form and another compartment comprising a composition in liquid form. The composition is preferably enveloped by a water-soluble film such as polyvinyl alcohol. Especially preferred are compositions in unit dose form wrapped in a polyvinyl alcohol film having a thickness of less than 100 μm. The detergent composition of the invention weighs from about 8 to about 25 grams, preferably from about 10 to about 20 grams. This weight range fits comfortably in a dishwasher dispenser. Even though this range amounts to a low amount of detergent, the detergent has been formulated in a way that provides all the benefits mentioned herein above.

The composition is preferably phosphate free. By "phosphate-free" is herein understood that the composition comprises less than 1%, preferably less than 0.1% by weight of the composition of phosphate.

Excellent cleaning and shine benefits are obtained with compositions comprising the copolymer, and a high level of complexing agent. For the purpose of this invention a "complexing agent" is a compound capable of binding polyvalent ions such as calcium, magnesium, lead, copper, zinc, cadmium, mercury, manganese, iron, aluminium and other cationic polyvalent ions to form a water-soluble complex. The complexing agent has a logarithmic stability constant ([log K]) for Ca2+ of at least 5, preferably at least 6. The stability constant, log K, is measured in a solution of ionic strength of 0.1, at a temperature of 25° C.

The composition of the invention comprises a high level of a complexing agent, preferably selected from the group consisting of methyl-glycine-diacetic acid (MGDA) and its salts, glutamic-N,N-diacetic acid (GLDA) and its salts, iminodisuccinic acid (IDS) and its salts, carboxy methyl inulin and its salts and mixtures thereof. Especially preferred complexing agent for use herein is selected from the group consisting of MGDA and salts thereof, especially preferred for use herein is the three sodium salt of MGDA. Preferably, the complexing agent is the three sodium salt of MGDA. Preferably the composition comprises a dispersant polymer, more preferably a sulfonated polymer, and especially a sulfonated polymer comprising 2-acrylamido-2-methylpropane sulfonic acid monomer.

Dispersant Polymer

A dispersant polymer can be used in any suitable amount from about 0.1 to about 20%, preferably from 0.2 to about 15%, more preferably from 0.3 to 5% by weight of the composition.

The dispersant polymer is capable to suspend calcium or calcium carbonate in an automatic dishwashing process.

The dispersant polymer has a calcium binding capacity within the range between 30 to 250 mg of Ca/g of dispersant polymer, preferably between 35 to 200 mg of Ca/g of dispersant polymer, more preferably 40 to 150 mg of Ca/g of dispersant polymer at 25° C. In order to determine if a polymer is a dispersant polymer within the meaning of the invention, the following calcium binding-capacity determination is conducted in accordance with the following instructions:

Calcium Binding Capacity Test Method

The calcium binding capacity referred to herein is determined via titration using a pH/ion meter, such as the Meettler Toledo SevenMulti™ bench top meter and a PerfectION™ comb Ca combination electrode. To measure the binding capacity a heating and stirring device suitable for beakers or tergotometer pots is set to 25° C., and the ion electrode with meter are calibrated according to the manufacturer's instructions. The standard concentrations for the electrode calibration should bracket the test concentration and should be measured at 25° C. A stock solution of 1000 mg/g of Ca is prepared by adding 3.67 g of $CaCl_2$-$2H_2O$ into 1 L of deionised water, then dilutions are carried out to prepare three working solutions of 100 mL each, respectively comprising 100 mg/g, 10 mg/g, and 1 mg/g concentrations of Calcium. The 100 mg Ca/g working solution is used as the initial concentration during the titration, which is conducted at 25° C. The ionic strength of each working solution is adjusted by adding 2.5 g/L of NaCl to each. The 100 mL of 100 mg Ca/g working solution is heated and stirred until it reaches 25° C. The initial reading of Calcium ion concentration is conducted at when the solution reaches 25° C. using the ion electrode. Then the test polymer is added incrementally to the calcium working solution (at 0.01 g/L intervals) and measured after 5 minutes of agitation following each incremental addition. The titration is stopped when the solution reaches 1 mg/g of Calcium. The titration procedure is repeated using the remaining two calcium concentration working solutions. The binding capacity of the test polymer is calculated as the linear slope of the calcium concentrations measured against the grams/L of test polymer that was added.

The dispersant polymer preferably bears a negative net charge when dissolved in an aqueous solution with a pH greater than 6.

The dispersant polymer can bear also sulfonated carboxylic esters or amides, in order to increase the negative charge at lower pH and improve their dispersing properties in hard water. The preferred dispersant polymers are sulfonated/carboxylated polymers, i.e., polymer comprising both sulfonated and carboxylated monomers.

Preferably, the dispersant polymers are sulfonated derivatives of polycarboxylic acids and may comprise two, three, four or more different monomer units. The preferred copolymers contain:

At least one structural unit derived from a carboxylic acid monomer having the general formula (III):

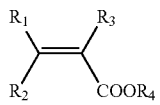

(III)

wherein $R_1$ to $R_3$ are independently selected from hydrogen, methyl, linear or branched saturated alkyl groups having from 2 to 12 carbon atoms, linear or branched mono or polyunsaturated alkenyl groups having from 2 to 12 carbon atoms, alkyl or alkenyl groups as aforementioned substituted with —NH2 or —OH, or —COOH, or $COOR_4$, where $R_4$ is selected from hydrogen, alkali metal, or a linear or branched, saturated or unsaturated alkyl or alkenyl group with 2 to 12 carbons;

Preferred carboxylic acid monomers include one or more of the following: acrylic acid, maleic acid, maleic anhydride, itaconic acid, citraconic acid, 2-phenylacrylic acid, cinnamic acid, crotonic acid, fumaric acid, methacrylic acid, 2-ethylacrylic acid, methylenemalonic acid, or sorbic acid. Acrylic and methacrylic acids being more preferred.

Optionally, one or more structural units derived from at least one nonionic monomer having the general formula (IV):

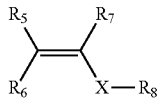

(IV)

Wherein $R_5$ to $R_7$ are independently selected from hydrogen, methyl, phenyl or hydroxyalkyl groups containing 1 to 6 carbon atoms, and can be part of a cyclic structure, X is an optionally present spacer group which is selected from —$CH_2$—, —COO—, —CONH— or —$CONR_8$—, and $R_8$ is selected from linear or branched, saturated alkyl radicals having 1 to 22 carbon atoms or unsaturated, preferably aromatic, radicals having from 6 to 22 carbon atoms.

Preferred non-ionic monomers include one or more of the following: butene, isobutene, pentene, 2-methylpent-1-ene, 3-methylpent-1-ene, 2,4,4-trimethylpent-1-ene, 2,4,4-trimethylpent-2-ene, cyclopentene, methylcyclopentene, 2-methyl-3-methyl-cyclopentene, hexene, 2,3-dimethylhex-1-ene, 2,4-dimethylhex-1-ene, 2,5-dimethylhex-1-ene, 3,5-dimethylhex-1-ene, 4,4-dimethylhex-1-ene, cyclohexene, methylcyclohexene, cycloheptene, alpha olefins having 10 or more carbon atoms such as, dec-1-ene, dodec-1-ene, hexadec-1-ene, octadec-1-ene and docos-1-ene, preferred aromatic monomers are styrene, alpha methylstyrene, 3-methylstyrene, 4-dodecylstyrene, 2-ethyl-4-bezylstyrene, 4-cyclohexylstyrene, 4-propylstyrol, 1-vinylnaphtalene, 2-vinylnaphtalene; preferred carboxylic ester monomers are methyl (meth)acrylate, ethyl (meth)acrylate, propyl (meth) acrylate, t-butyl (meth)acrylate, pentyl (meth)acrylate, hexyl (meth)acrylate, 2-ethylhexyl (meth)acrylate, octyl (meth) acrylate, lauryl (meth)acrylate, stearyl (meth)acrylate and behenyl (meth)acrylate; preferred amides are N-methyl acrylamide, N-ethyl acrylamide, N-t-butyl acrylamide, N-2-ethylhexyl acrylamide, N-octyl acrylamide, N-lauryl acrylamide, N-stearyl acrylamide, N-behenyl acrylamide.

and at least one structural unit derived from at least one sulfonic acid monomer having the general formula (V) and (VI):

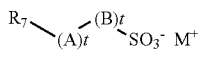

(V)

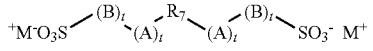

(VI)

wherein $R_7$ is a group comprising at least one sp2 bond, A is O, N, P, S, an amido or ester linkage, B is a mono- or polycyclic aromatic group or an aliphatic group, each t is independently 0 or 1, and M+ is a cation. In one aspect, $R_7$ is a C2 to C6 alkene. In another aspect, R7 is ethene, butene or propene.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxy-propanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfo-propylmethacrylate, sulfomethacrylamide, sulfomethylmethacrylamide and mixtures of said acids or their water-soluble salts.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is preferably (meth)acrylic acid. The sulfonic acid monomer is preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

Suitable dispersant polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, preferably from about 5,000 to about 45,000 g/mol. The dispersant polymer may be a low molecular weight homopolymer of polyacrylate, with an average molecular weight of from 1,000 to 20,000, particularly from 2,000 to 10,000, and particularly preferably from 3,000 to 5,000.

The dispersant polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000 and more preferably from 20,000 to 50,000 and in particular 30,000 to 40,000 g/mol. and a ratio of (meth)acrylate to maleate or fumarate segments of from 30:1 to 1:2.

The dispersant polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such dispersant polymer may have a molecular weight of from 4,000 to 20,000 and an acrylamide content of from 0% to 15%, by weight of the polymer.

Dispersant polymers suitable herein also include itaconic acid homopolymers and copolymers.

Alternatively, the dispersant polymer can be selected from the group consisting of alkoxylated polyalkyleneimines, alkoxylated polycarboxylates, polyethylene glycols, styrene co-polymers, cellulose sulfate esters, carboxylated polysaccharides, amphiphilic graft copolymers and mixtures thereof.

Bleach

The composition of the invention preferably comprises from about 1 to about 20%, more preferably from about 5 to about 18%, even more preferably from about 8 to about 15% of bleach by weight of the composition.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially dodecanediperoxoic acid, tetradecanediperoxoic acid, and hexadecanediperoxoic acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5, preferably from 0.2 to 2% by weight of the composition of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the composition. Preferably the bleach catalyst is a manganese bleach catalyst.

Inorganic Builder

The composition of the invention preferably comprises an inorganic builder. Suitable inorganic builders are selected from the group consisting of carbonate, silicate and mixtures thereof. Especially preferred for use herein is sodium carbonate. Preferably the composition of the invention comprises from 5 to 50%, more preferably from 10 to 40% and especially from 15 to 30% of sodium carbonate by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]x[CH2CH2O]y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Enzymes

In describing enzyme variants herein, the following nomenclature is used for ease of reference: Original amino acid(s):position(s): substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, S130A, Y167A, R1705, A194P, V2051 and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+S130A (iii) N76D+N87R+G118R+S128L+P129Q+S130A+S188D+N248R (iv) N76D+N87R+G118R+S128L+P129Q+S130A+S188D+V244R (v) N76D+N87R+G118R+S128L+P129Q+S130A (vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 7 and especially from about 1 to about 6 mg of active protease.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATA- LASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 5%, more preferably from 0.05 to 3% and especially from 0.5 to 2% of a crystal growth inhibitor by weight of the product, preferably HEDP.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.1 to 5%, more preferably from 0.2 to 4% and specially from 0.3 to 3% by weight of the composition of a metal care agent, preferably the glass care agent is a zinc containing material, specially hydrozincite.

The automatic dishwashing composition of the invention preferably has a pH as measured in 1% weight/volume aqueous solution in distilled water at 20° C. of from about 9 to about 12, more preferably from about 10 to less than about 11.5 and especially from about 10.5 to about 11.5.

The automatic dishwashing composition of the invention preferably has a reserve alkalinity of from about 10 to about 20, more preferably from about 12 to about 18 at a pH of 9.5 as measured in NaOH with 100 grams of product at 20° C.

A preferred automatic dishwashing composition of the invention include:

i) from 2 to 20% by weight of the composition of bleach, preferably sodium percarbonate;
ii) preferably a bleach activator, more preferably TAED;
iii) enzymes, preferably amylases and proteases;
iv) optionally but preferably from 5 to 30% by weight of the composition of an inorganic builder, preferably sodium carbonate;
v) optionally but preferably from 2 to 10% by weight of the composition of a non-ionic surfactant;
vi) optionally a bleach catalyst;
vii) other optional ingredients include: a crystal growth inhibitor, preferably HEDP, and glass care agents.

Hand Dishwashing Cleaning Composition

The composition of the invention when used for manual dishwashing is usually in liquid form. It typically contains from 30% to 95%, preferably from 40% to 90%, more preferably from 50% to 85% by weight of a liquid carrier in which the other essential and optional components are dissolved, dispersed or suspended. One preferred component of the liquid carrier is water.

Preferably the pH (measured in a 10% solution in distilled water) of the composition is adjusted between 3 and 14, more preferably between 4 and 13, more preferably between 6 and 12 and most preferably between 8 and 10. Alternatively the pH of the composition is adjusted between 2 and 6, preferably between 3 and 5.

The hand dishwashing composition can be in the form of a liquid, semi-liquid, cream, lotion or gel compositions. The composition can have a Newtonian or non-Newtonian rheology profile with a high shear viscosity of between 1 centipoises (cps) and 10,000 cps at 20° C., preferably between 200 cps and 5000 cps, more preferably between 300 cps and 3000 cps, even more preferably between 400 and 2000 cps, most preferably between 1000 and 1500 cps, alternatively combinations thereof. High shear viscosity is measured with a BROOKFIELD DV-E viscometer, at 20° C., spindle number 31. The following rotations per minute (rpm) should be used depending upon the viscosity: between 300 cps to below 500 cps is at 50 rpm; between 500 cps to less than 1,000 cps is at 20 rpm; from 1,000 cps to less than 1,500 cps at 12 rpm; from 1,500 cps to less than 2,500 cps at 10 rpm; from 2,500 cps, and greater, at 5 rpm. Those viscosities below 300 cps are measured at 12 rpm with spindle number 18.

The hand dishwashing composition preferably comprises a surfactant system and more preferably a number of other optional ingredients such as builders, chelants, rheology modifying polymers, conditioning polymers, cleaning polymers, other surface modifying polymers, soil flocculating polymers, structurants, emmolients, humectants, skin rejuvenating actives, enzymes, carboxylic acids, organic amines, scrubbing particles, bleach and bleach activators, perfumes, malodor control agents, pigments, dyes, opacifiers, beads, pearlescent particles, microcapsules, organic and inorganic cations such as alkaline earth metals such as Ca/Mg-ions and diamines, suds suppressors/stabilizers/boosters, organic solvents, inorganic salts such as NaCl, antibacterial agents, preservatives, UV stabilizers and pH adjusters and buffering means.

The hand dishwashing composition can comprise from about 1% to about 50%, preferably from about 5% to about 40% more preferably from about 8% to about 35% by weight thereof of a surfactant system. The surfactant system preferably comprises an anionic surfactant, more preferably a sulphate or a sulphonate based anionic surfactant. The surfactant system can optionally comprise an amphoteric, non-ionic, zwitterionic, cationic surfactant and mixtures thereof.

Preferably, the surfactant system comprises alkyl sulfates and/or alkyl ethoxy sulfates anionic surfactants; more preferably a combination of alkyl sulfates and/or alkyl ethoxy sulfates with a combined average ethoxylation degree of less than 5, preferably less than 3, more preferably less than 2 and most preferably between 0.5 and 1. Preferably the anionic surfactant to be used in the hand dishwashing composition of the present invention is a branched anionic surfactant having an average level of branching of from about 5% to about 40%, preferably from about 10% to about 35% and more preferably from about 20% to about 30%.

Preferably, the composition of the present invention will further comprise amphoteric and/or zwitterionic surfactant, more preferably an amine oxide or betaine surfactant, most preferably an amine oxide. The anionic and amphoteric or zwitterionic surfactants are present in a weight ratio anionic to amphoteric or anionic to zwitterionic of from about 1:1 to about 8.5:1, more preferably in a weight ratio of less than about 5:1, and even more preferably in a weight ratio of less than about 4.5:1 and greater than 1.5, more preferably greater than 2.

The most preferred surfactant system for the hand dishwashing composition of the present invention will therefore comprise: (1) 1% to 40%, preferably 6% to 32%, more preferably 8% to 25% by weight of the total composition of an anionic surfactant, more preferably an alkyl sulphate or an alkyl ethoxy sulphate anionic surfactant or a mixture thereof, combined with (2) 0.01% to 20%, preferably from 0.2% to 15%, more preferably from 0.5% to 10% by weight of the composition of amphoteric and/or zwitterionic surfactant, more preferably an amphoteric surfactant, even more preferrably an amine oxide surfactant and most preferably an alkyldimethyl amine oxide surfactant.

Nonionic surfactant, when present, is comprised in a typical amount of from 0.1% to 30%, preferably 0.2% to 20%, most preferably 0.5% to 10% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol.

The hand dishwashing composition herein preferably comprises a surfactant system comprising an anionic (preferably a mixture of alkyl sulfates and/or alkyl ethoxy sulphates), an amphoteric (preferably an amine oxide surfactant) and a non-ionic surfactant.

EXAMPLES

Copolymer Synthesis

GPC(SEC) Method to Determine the Molecular Weight of the Copolymer

The weight average molecular weight of the polymers (Mw) is determined using Size Exclusion Chromatography (SEC). SEC separation conditions were three hydrophilic Vinylpolymer network gel columns, in distilled water with the presence of 0.1% (w/w) trifluoroacetic acid/0.1 M NaCl at 35° C. Calibration was done with narrowly distributed Poly(2-vinylpyridine)-standard of company PSS, Deutschland with molecular weights Mw=620 to Mw=2,070,000

Copolymer 1

80% wt MPEG-MA (methyl polyethyleneglycol methacrylate) with 45 EO (ethylene oxide) and 20% wt QVI (3-methyl-1-vinylimidazolium)

In a 4 L stirred vessel, water (838.5 g) was charged and heated to 90° C. under a flow of nitrogen. A solution of Wako V50 (1.35 g, Wako Pure Chemical Industries, Ltd.) in water (12.15 g) was added over 4 h and a solution of methoxypolyethylenglycol methacrylate with molecular weight ~2000 g/mol (50%, 1080 g, Visiomer MPEG 2005 MA W, Evonik Industries) and 3-Methyl-1-vinyl-1H-imidazolium-methyl-sulfate (45%, 300 g, BASF SE) over 3 hours. The polymerization mixture was kept at this temperature for an additional 30 min after both streams finished. Subsequently a solution of Wako V50 (3.38 g) in water (30.38 g) was added over 15 min, stirred for 1 h, then left to cool down to room temperature. The GPC gave values of weight average molecular weight is 143,000 g/mol.

Copolymer 2

80% wt MPEG-MA (methyl polyethyleneglycol methacrylate) with 45 EO (ethylene oxide) and 20% wt QVI (3-methyl-1-vinylimidazolium)

In a 4 L stirred vessel water (312.45 g) was charged and heated to 90° C. under a flow of nitrogen. A solution of Wako V50 (0.27 g, Wako Pure Chemical Industries, Ltd.) in water (26.46 g) was added over 4 h and a solution of methoxypolyethylenglycol methacrylate with molecular weight ~2000 g/mol (50%, 432.00 g, Visiomer MPEG 2005 MA W, Evonik Industries) and 3-Methyl-1-vinyl-1H-imidazolium-methyl-sulfat (45%, 120.00 g, BASF SE) over 3 hours. The polymerization mixture was kept at this temperature for an additional 30 min after both streams have finished. Subsequently, a solution of Wako V50 (1.35 g) in water (13.50 g) was added over 15 min, stirred for 1 h and then left to cool down to room temperature. The GPC gave values of Mw=179,000 g/mol

EXAMPLE DISHWASHING COMPOSITIONS

The composition tabulated below was made into a superposed dual-compartment water-soluble pouch. One compartment contained the solid composition and the other compartment the liquid composition.

TABLE 1

| Formulation | | |
|---|---|---|
| | | Composition (g active per wash) |
| Powder | MGDA | 5.76 |
| | HEDP | 0.1 |
| | Sodium Carbonate | 2.69 |
| | Amylase | 0.008 |
| | Protease | 0.038 |
| | Sodium Percarbonate | 2.75 |
| | Bleach catalyst | 0.004 |
| | Copolymer 1 | 0.5 |
| | Sulfonated polymer | 0.38 |
| | Nonionic surfactant 1 | 0.10 |
| | BTA | 0.008 |
| Liquid Top | Nonionic surfactant 1 | 0.73 |
| | Nonionic surfactant 2 | 0.89 |
| | DPG | 0.40 |
| | Glycerine | 0.02 |
| | Dye | 0.0005 |
| | Water | 0.11 |

| | |
|---|---|
| MGDA | Trisodium salt of methylglycinediacetic acid, supplied by BASF |
| Sulphonated Polymer | Acusol 588 supplied by Rohm & Haas |
| Bleach catalyst | MnTACN (Manganese 1,4,7-Triazacyclononane) |
| Nonionic surfactant 1 | Plurafac SLF 180, supplied by BASF. |
| Nonionic surfactant 2 | Lutensol TO7, supplied by BASF. |
| Amylase | Stainzyme Plus, supplied by Novozymes |
| Protease | Ultimase, supplied by DuPont |
| HEDP | 1-hydroxyethane 1,1-diphosphonic acid |
| Copolymer 1 | 80% wt MPEG with 45 EO and 20% wt QVI, Mw 40,000-80,000 |

The pouch was used to wash a dishwashing load in an automatic dishwashing in the presence of soils, the dishwashing load comprises glasses. At the end of the dishwashing process the washed items presented good shine, very little spotting and felt clean.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dishwashing cleaning composition comprising a cationic copolymer, wherein the copolymer comprises:

i. From about 60 to about 99% by weight of at least one monoethylenically unsaturated polyalkylene oxide monomer of the formula I (monomer (A))

I

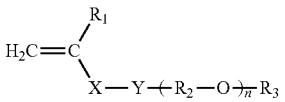

in which the variables have the following meanings:

X is —CH2- or —CO—, if Y is —O—;

is —CO—, if Y is —NH—;

Y is —O— or NH—;

R1 is hydrogen or methyl;

R2 are identical or different C2-C6-alkylene radicals;

R3 is H or C1-C4 alkyl;

n is an integer from 20 to 100, ii. from about 1 to about 40% by weight of at least one quaternized nitrogen-containing monomer, selected from the group consisting of at least one of the monomers of the formula IIa to IId (monomer (B))

IIa

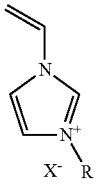

-continued

IIb

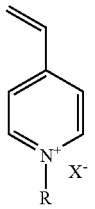

IIc

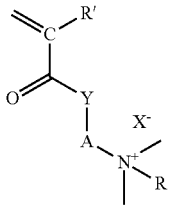

IId

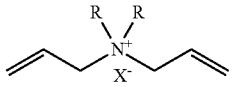

in which the variables have the following meanings:

R is C1-C4 alkyl or benzyl;

R' is hydrogen or methyl;

Y is —O— or —NH—;

A is C1-C6 alkylene;

X— is halide, C1-C4-alkyl sulfate, C1-C4-alkylsulfonate and C1-C4-alkyl carbonate, iii. From 0 to about 15% by weight of at least one anionic monoethylenically unsaturated monomer (monomer (C)), and iv. from 0 to about 30% by weight of at least one other nonionic monoethylenically unsaturated monomer (monomer (D)), wherein the copolymer has a weight average molecular weight (Mw) from about 35,000 g/mol to about 100,000 g/mol;

and more than about 30% by weight of the composition of a complexing agent selected from the group consisting of methyl glycine diacetic acid, glutamic-N,N-diacetic acid, iminodisuccinic acid, carboxy methyl inulin, their salts, and mixtures thereof.

2. The dishwashing cleaning composition according to claim 1 wherein the complexing agent is a salt of methyl glycine diacetic acid.

3. The dishwashing cleaning composition according to claim 1 in which the variables of monomer (A) have the following meanings:

X is —CO—;

Y is —O—;

R1 is hydrogen or methyl;

R2 is ethylene, linear or branched propylene or mixtures thereof;

R3 is methyl;

n is an integer from 30 to 60.

4. The dishwashing cleaning composition according to claim 1, where the cationic copolymer comprises from about 60% to about 98% by weight of monomer (A) and from about 1 to about 39% by weight of monomer B and from about 0.5% to about 6% by weight of monomer (C).

5. The dishwashing cleaning composition according claim 1 wherein monomer (A) is methylpolyethylene glycol (meth)acrylate.

6. The dishwashing cleaning composition according to claim 1 wherein monomer (B) is a salt of 3-methyl-1-vinylimidazolium.

7. The dishwashing cleaning composition according to claim 1, wherein the cationic copolymer comprises from about 69% to 89% of monomer (A) and from about 9% to about 29% of monomer (B).

8. The dishwashing cleaning composition according to claim 1 wherein monomer (A) is methylpolyethylene glycol (meth)acrylate and wherein monomer (B) is a salt of 3-methyl-1-vinylimidazolium.

9. The dishwashing cleaning composition according to claim 1 wherein the weight ratio of monomer (A) to monomer (B) is ≥2:1 and for the case where the copolymer comprises a monomer (C), the weight ratio of monomer (B) to monomer (C) is also ≥2:1, and monomer (A) comprises methylpolyethylene glycol (meth)acrylate and monomer (B) comprises a salt of 3-methyl-1-vinylimidazolium.

10. The dishwashing cleaning composition according to claim 1 wherein the composition is an automatic dishwashing composition comprising from about 0.1 to about 10% of the copolymer by weight of the composition and the composition is phosphate free.

11. The dishwashing cleaning composition according to claim 1 wherein the composition comprises a dispersant polymer.

12. The dishwashing cleaning composition according to claim 1 wherein the composition comprises a carboxylated/sulfonated polymer.

13. The dishwashing cleaning composition according to claim 1 wherein the composition comprises bleach.

14. The dishwashing cleaning composition according to claim 1 wherein the composition comprises bleach and a bleach catalyst.

15. The dishwashing cleaning composition according to claim 1 wherein the composition is an automatic dishwashing composition comprising:

a) From about 0.1% to about 10% of the copolymer by weight of the composition;

b) From about 30% to about 60% by weight of the composition of a salt of methyl glycine diacetic acid; and c) From 0% to 10% by weight of the composition of a carboxylated/sulfonated polymer.

16. The dishwashing cleaning composition according to claim 1 wherein the composition is in unit dose form.

17. The dishwashing cleaning composition according to claim 1 wherein the composition is in the form of a water-soluble pack.

18. A method of reducing the number of spots on dishware during automatic dishwashing, the method comprising the following steps:

a) providing soiled dishware;

b) placing the soiled dishware into an automatic dishwasher;

c) providing an automatic dishwashing cleaning composition according to claim 1; and d) running the automatic dishwasher, wherein the copolymer in the automatic dishwashing cleaning composition contributes to the reduction of number of spots on dishware.

19. A method of washing soiled dishware in a dishwasher to provide visual and tactile cleaning comprising the steps of:

a) providing the soiled dishware;

b) treating the dishware with a cleaning composition comprising the composition of claim 1; and optionally rinsing the dishware.

* * * * *